US005891599A

United States Patent [19]

Fujimoto et al.

[11] Patent Number: 5,891,599

[45] Date of Patent: Apr. 6, 1999

[54] ELECTROPHOTOGRAPHIC PHOTORECEPTOR

[75] Inventors: Shingo Fujimoto, Hino; Akihiko Itami; Tomoo Sakimura, both of Hachioji, all of Japan

[73] Assignee: Konica Corporation, Tokyo, Japan

[21] Appl. No.: 137,967

[22] Filed: Aug. 21, 1998

[30] Foreign Application Priority Data

Aug. 27, 1997 [JP] Japan ..... 9-230924

[51] Int. Cl.[6] ..... G03G 5/047; G03G 5/09

[52] U.S. Cl. ..... 430/59; 430/58; 430/83

[58] Field of Search ..... 430/58, 59, 83

[56] References Cited

U.S. PATENT DOCUMENTS

| | | | |
|---|---|---|---|
| 5,344,733 | 9/1994 | Suzuki et al. | 430/58 |
| 5,380,613 | 1/1995 | Ueda et al. | 430/58 |
| 5,401,615 | 3/1995 | Pai et al. | 430/59 |
| 5,474,868 | 12/1995 | Adachi et al | 430/58 |
| 5,618,646 | 4/1997 | Nogami et al. | 430/83 |
| 5,707,766 | 1/1998 | Nogami et al. | 430/83 |
| 5,721,081 | 2/1998 | Takagi et al. | 430/59 |

*Primary Examiner*—Roland Martin
*Attorney, Agent, or Firm*—Cantor Colburn LLP

[57] ABSTRACT

An electrophotographic photoreceptor is disclosed. The photosensitive layer of the photoreceptor comprises a compound represented by formula (A),

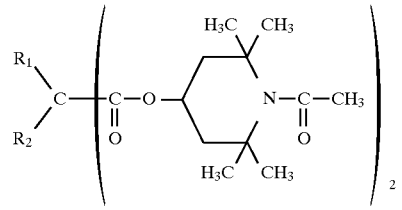

(A)

wherein $R_1$ represents a group represented by formula (B), and $R_2$ represents a group represented by formula (B), a hydrogen atom or an alkyl group having from 1 to 9 carbon atoms,

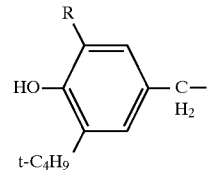

(B)

wherein formula R represents an alkyl group having from 1 to 9 carbon atoms.

10 Claims, No Drawings

ELECTROPHOTOGRAPHIC PHOTORECEPTOR

The present invention relates to an electrophotographic photoreceptor to form an electrostatic latent image, and more specifically, to an electrophotographic photoreceptor which exhibits excellent environment resistance, minimum residual potential and excellent durability with stable potential properties during repeated usage.

BACKGROUND OF THE INVENTION

Conventionally, regarding electrophotographic photoreceptors, research and development on organic photoreceptors with a photosensitive layer comprised of an organic photoconductive compound as a main constituent have been conducted.

The surface layer of the organic photoreceptor is subjected to external application of electrical and mechanical forces such as corona discharging, toner development, image transfer to a sheet of paper, cleaning process, etc. Accordingly, the durability against those is required. Furthermore, when a photoreceptor is practically employed in a copier or printer, the photoreceptor surface is degraded by products generated by discharging at the electrode, such as ozone, nitrogen oxide ($NO_x$), etc., and ultraviolet radiation during exposure. Thus, environmental resistance is required.

As one of the technical measures used to minimize such degradation of a photoreceptor, the addition of various degradation minimizing agents and stabilizing agents has been proposed. For example, Japanese Patent Publication Open to Public Inspection No. 58-120260 describes a method in which benzotriazole compounds known as a UV absorber are added; Japanese Patent Publication Open to Public Inspection No. 63-52146 describes a method in which a p-phenylenediamine is added; Japanese Patent Publication Open to Public Inspection No. 63-58455 describes a method in which dihydroquinoline is added as ozone degradation minimizing agents; Japanese Patent Publication Open to Public Inspection Nos. 63-71856, 63-71857, 63-18355, and 3-73255 describe methods in which spiroindane, spirochroman, hindered-amine, and hindered-phenol are added as antioxidants; Japanese Patent Publication Open to Public Inspection Nos. 63-132224, 63-153553, and 63-153554 describe methods in which α-keto acid or aryl ketone compounds are added.

The additives mentioned above reduce the adverse effects due to ultraviolet radiation, ozone, $NO_x$, etc. However, residual potential is occasionally degraded. In recent years, in accordance with the increase in sensitivity of photoreceptors, photoreceptors are required to be mounted on copiers and printers exhibiting higher speed and more printing resistance. Furthermore, it has become difficult to remove discharge products around the photoreceptor because of the decrease in dimensions of copiers and printers. Because of the facts mentioned above, the durability of conventional photoreceptors has been found to be insufficient.

SUMMARY OF THE INVENTION

An object of the present invention is to provide an electrophotographic photoreceptor which exhibits excellent durability such as minimum variation in charging potential, sensitivity, residual potential, etc. during repeated usage, and stability in image properties such as line-broadening of characters, blurred image, etc.

The electrophotographic photoreceptor of the present invention comprises a conductive support having thereon a photosensitive layer comprising a carrier generating material and a carrier transport material, and the above-mentioned photosensitive layer comprises a compound represented by formula (A).

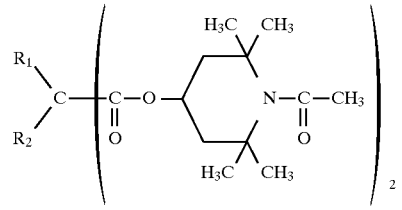

Wherein $R_1$ represents a group represented by formula (B), and $R_2$ represents a group represented by formula (B), a hydrogen atom or an alkyl group having from 1 to 9 carbon atoms.

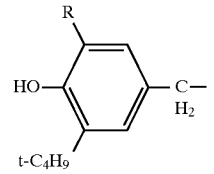

In the formula R represents an alkyl group having from 1 to 9 carbon atoms.

Specific examples of $R_2$ representing an alkyl group having from 1 to 9 carbon atoms include a methyl group, an ethyl group, a propyl group, a butyl group, a hexyl group, etc.

Specific examples of R representing an alkyl group having from 1 to 9 carbon atoms include a methyl group, an ethyl group, an isopropyl group, a t-butyl group, etc. Of these, the t-butyl group is particularly preferable.

Specific examples of compounds represented by formula (A) are shown.

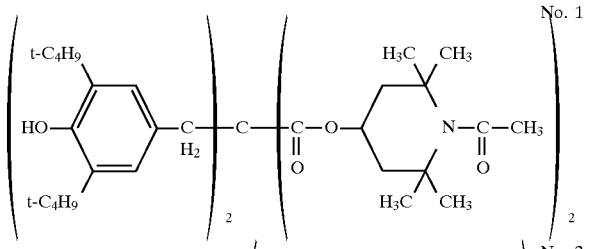

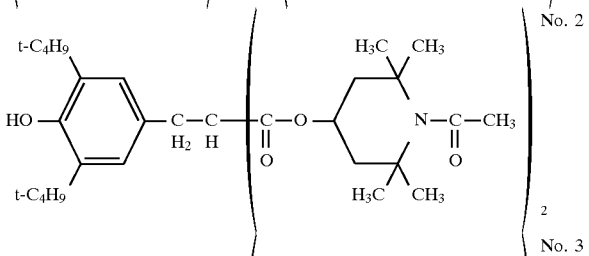

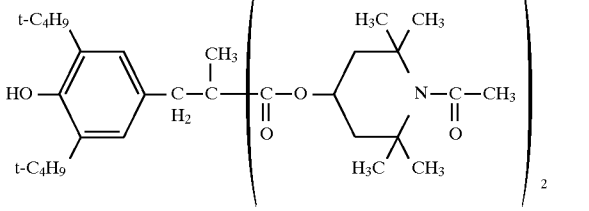

-continued

No. 4

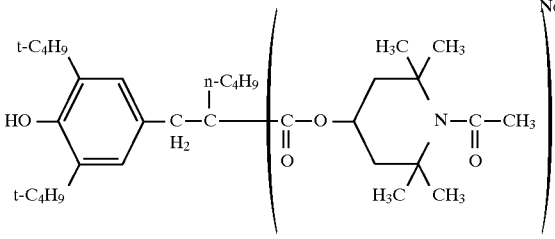

No. 5

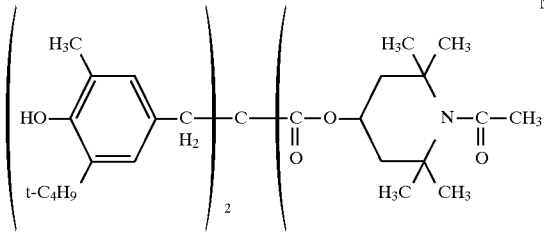

No. 6

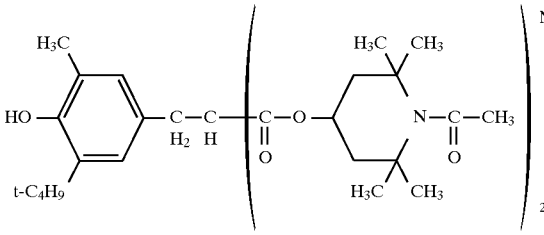

No. 7

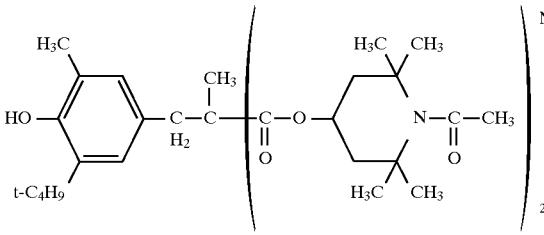

No. 8

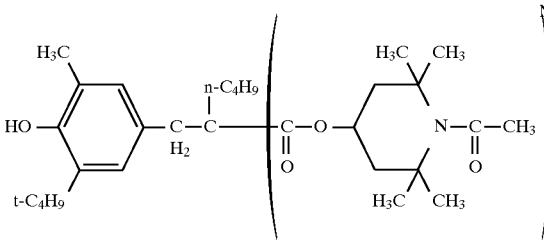

No. 9

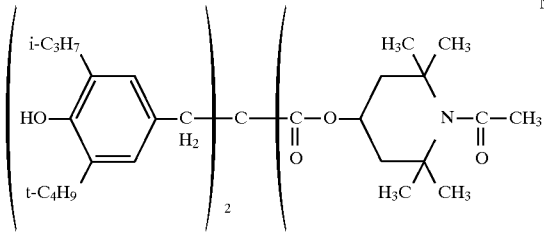

No. 10

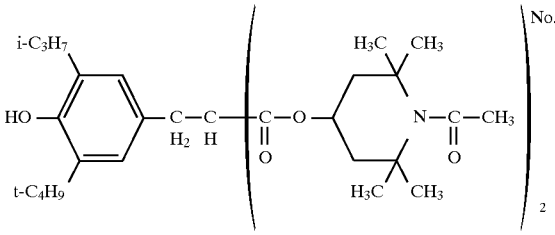

-continued

No. 11

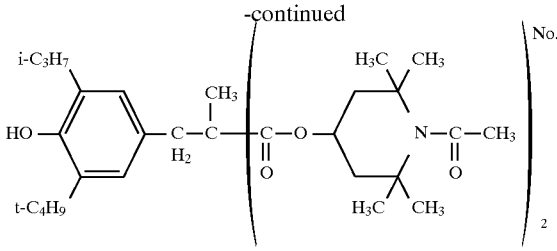

No. 12

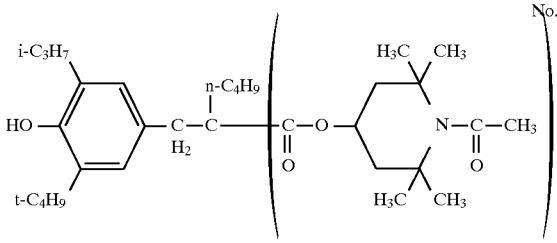

These compounds can be synthesized employing the synthesis methods mentioned below and methods described in publications, for example, Ger. Offen 24, 56, 864, Ger. Offen 26, 54, 058, and HELVETICA CHIMICA ACTA 59(2) 522 to 532 (1976), etc.

(Synthesis Example 1, Synthesis of Exemplified Compound 1)

To 100 ml of acetic acid anhydride, 20.5 g (0.025 mole) of 2,2-bis(3,5-di-t-butyl-4-hydroxybenzyl)malonic acid bis (2,2,6,6-tetramethylpyperidine-4-il)ester was added and the resulting mixture was allowed to react with stirring at 130° to 140° C. for two hours.

After reaction, the reaction liquid was poured into 800 ml of ice water and the deposited crystals were collected by filtration. Furthermore, the resulting crystals were washed two times with stirring employing 500 ml of water. After filtration and drying, raw crystals were recrystallized employing toluene/hexane to obtain the targeted Exemplified Compound 1. The yield was 17.8 g (79%).

The photoreceptor may be composed of a single layer having a photosensitive layer comprising a carrier generating material and a carrier transport material on a conductive support. Furthermore, it may be composed of double-layered photosensitive layer consisting of a carrier generating layer comprising a carrier generating material and a carrier transport layer comprising a carrier transport material. The carrier generating material and the carrier transport material are dispersed or dissolved in a binder to form a layer. When desired, an interlayer may be provided between the conductive support and the photosensitive layer, and a protective layer may be provided on the photosensitive layer.

The weight percent of the above-mentioned compounds incorporated into the photosensitive layer is between 0.1 and 20, and preferably between 1 and 10.

Any compound may be employed as the carrier transport material in the photoreceptor. Examples include triarylamine compounds, triarylaminestyryl compounds, hydrazone compounds, and pyrazoline compounds.

Triphenylamine compounds represented by formula (C) are particularly preferred.

Formula (C)

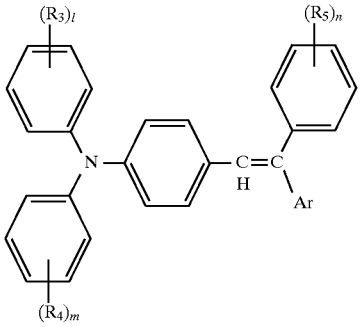

$R_3$, $R_4$, and $R_5$ each independently represents an alkyl group or alkoxy group having from 1 to 5 carbon atoms and is preferably a methyl group and a methoxy group.

1, m, and n each independently represents an integer of 0 to 3, preferably 0 or 1.

Ar represents a hydrogen atom or a substituted or unsubstituted phenyl group, and is most preferably a phenyl group. As the substituent of the phenyl group, an alkyl group having carbon atoms of 1 to 5 such as a methyl or ethyl group; or an alkoxy group having carbon atoms of 1 to 5 such as a methoxy or ethoxy group.

Specific examples represented by formula (C) are shown below.

(P-1)

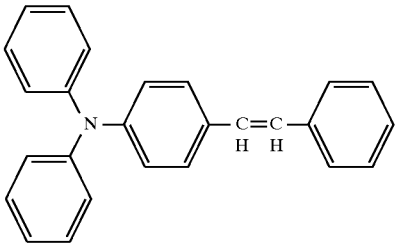

(P-2)

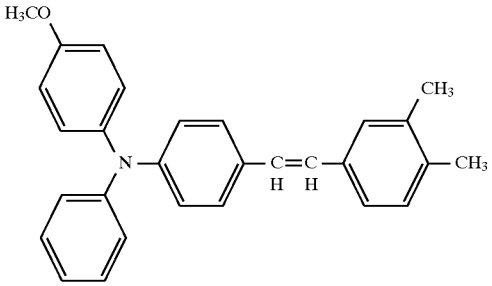

(P-3)

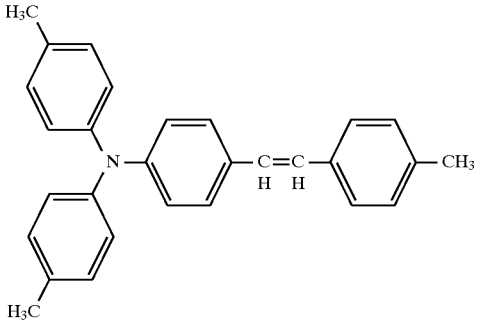

-continued (P-4)

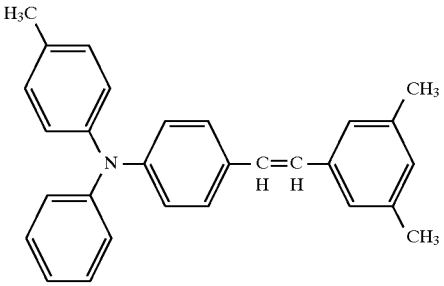

(P-5)

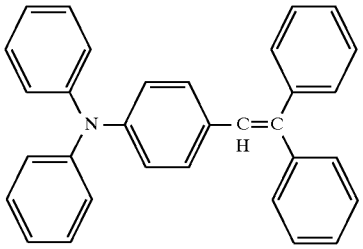

(P-6)

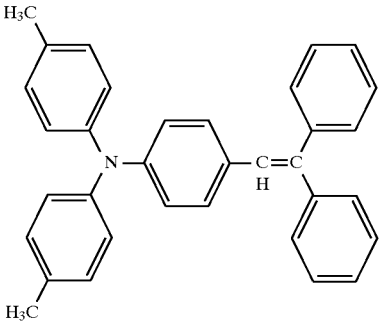

(P-7)

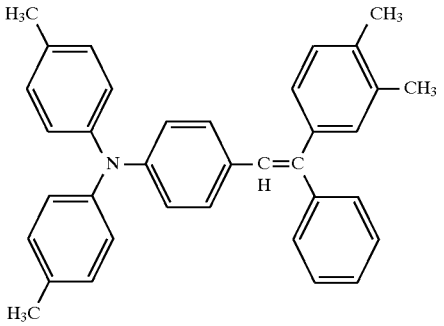

(P-8)

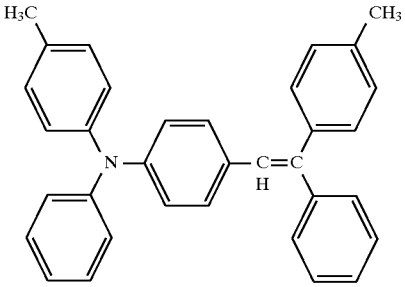

-continued (P-9)

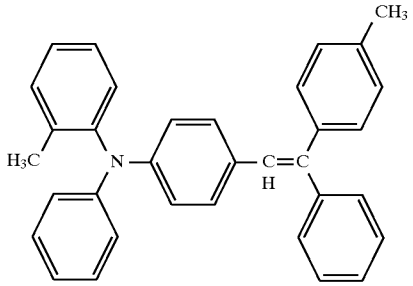

(P-10)

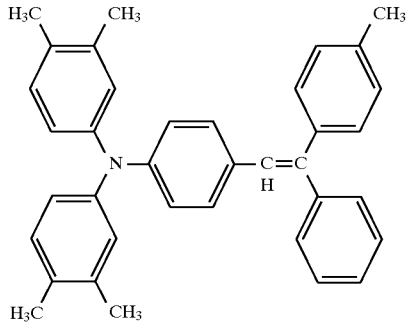

(P-11)

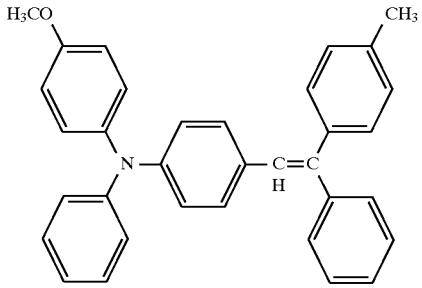

(P-12)

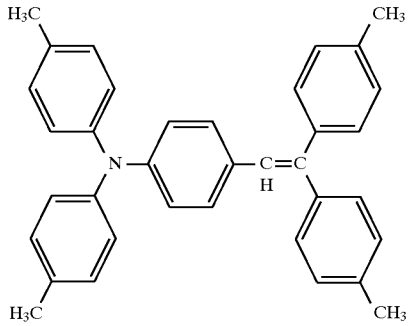

(P-13)

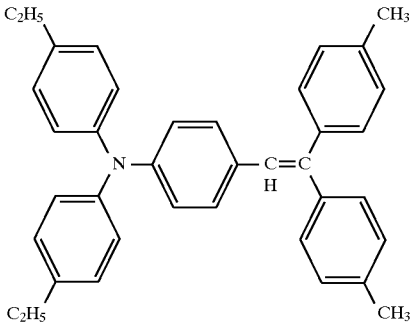

-continued (P-14)

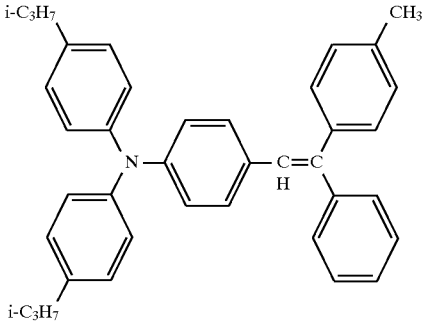

(P-15)

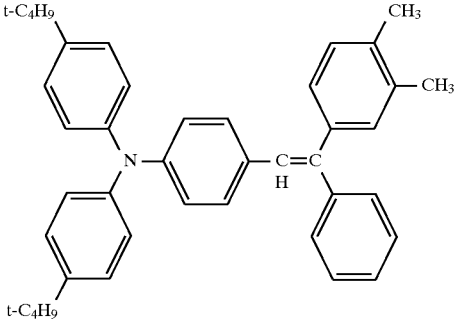

(P-16)

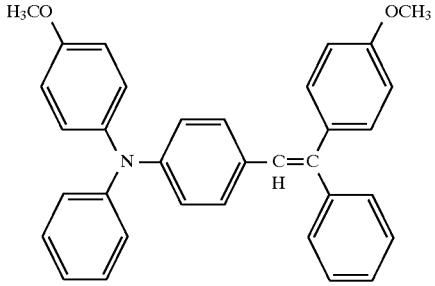

Any compound may be employed as the carrier generating material in a photoreceptor. The examples include phthalocyanine compounds, azo compounds, pyrylium compounds, perylene series compounds, cyanine series compound, squalium compounds, and polycyclic quinone compounds.

Of phthalocyanine compounds, titanylphthalocyanine is preferable with a specific crystal system exhibiting peaks at 9.5°, 24.1°, and 27.2° of Bragg angle 2θ in the X-ray diffraction is preferable.

Of azo compounds, the bisazo compounds are preferred with the structure shown below.

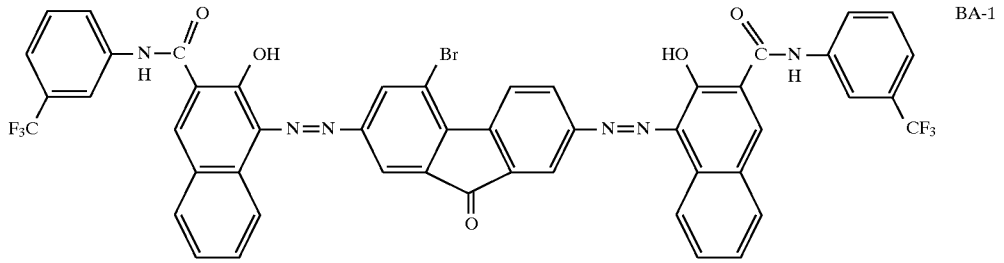

Of perylene compounds, the perylene compounds (mixtures of isomers) are preferred with the structure shown below.

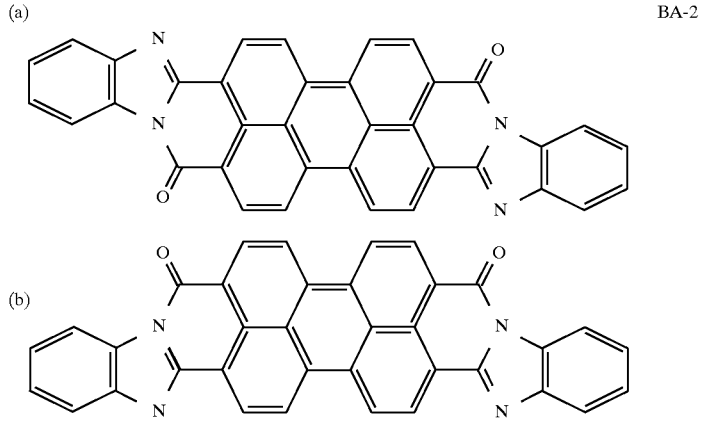

Binder resins employed in a single photosensitive layer, the carrier generating layer and carrier transport layer in a double-layered photosensitive layer, and a protective layer of a photoreceptor include, for example, polycarbonate resins, polystyrene resins, polyacryl resins, polyvinyl butyral resins, epoxy resins, polyurethane resins, phenol resins, polyester resins, alkyd resins, silicone resins, melamine resins, and copolymers comprising at least two repeated units of these resins. Furthermore, in addition to insulating resins, high polymer organic semiconductors are included.

In addition to the compounds mentioned above, spectral sensitization correcting dyes may be incorporated. Furthermore, other additives such as antioxidants may be added in combination.

The photosensitive layer can be prepared by coating a dispersion which is prepared by dissolving or dispersing, in a suitable solvent, this compound together with a resin, if desired, with a carrier transport material and a carrier generating material, employing an applicator, a bar coater, a dip coater, a circular slide hopper, etc. by drying the coating. The solvents employed to prepare the dispersion include, for example, hydrocarbons such as toluene, xylene, etc.; halogenated hydrocarbons such as methylene chloride, 1,2-dichloroethane, etc.; ketones such as methyl ethyl ketone, cyclohexanone, etc.; esters such as ethyl acetate, butyl acetate, etc.; alcohols and derivatives thereof such as methanol, ethanol, propanol, butanol, methyl cellosolve, ethyl cellosolve, etc.; ethers such as tetrahydrofuran, 1,4-dioxane, 1,3-dioxolane, etc.; amines such as pyridine, diethylamine, etc.; nitrogen-containing compounds of amides such as N,N-dimethylformamide, etc.; fatty acids and phenols; sulfur and phosphorous compounds such as carbon disulfide, triethyl phosphate, and combinations of one or more of these compounds.

Binders employed in the interlayer include, for example, polyamide resins, vinyl chloride resins, vinyl acetate resins, and copolymer resins comprising at least two repeating units of these resins, and furthermore, hardened metal resins prepared by thermally hardening organic metal compounds such as silane coupling agents, titanium coupling agents, etc.

EXAMPLES

In the following, the present invention is specifically shown with reference to Examples.

Example 1

Onto an cylindrical aluminum drum subjected to compacks treatment, a solution prepared by dissolving 30 parts of a titanium coupling agent "TC750" (manufactured by Matsumoto Seiyaku Co.) and 17 parts of a silane coupling agent "KBM503" (manufactured by Shin-Etsu Kagaku Kogyo Co.) in 150 parts of isopropanol was dip-coated and the resulting coating was hardened at 105° C. for 25 minutes to provide an interlayer with a thickness of 1.0 $\mu$m.

Onto the resulting coating, a dispersion prepared by dispersing 10 parts of titanylphthalocyanine with peaks at 9.5°, 24.1°, and 27.2° of Bragg angle 2θ in X-ray diffraction as a carrier generating material, and 10 parts of a silicone resin "KR-5240" (manufactured by Shin-Etsu Kagaku Kogyo Co.) in 1,000 parts of t-butyl acetate was coated employing a circular slide hopper to form a carrier generating layer with a thickness of 0.3 $\mu$m.

Thereafter, onto the carrier generating layer, a solution prepared by dissolving 120 parts of a carrier transport material (P-6), 6 parts of Exemplified Compound No. 1, and 160 parts of a polycarbonate resin "Upiron Z-300" (manufactured by Mitsubishi Gas Kagaku Co.) in 1,000 parts of ethylene chloride was coated employing a circular slide hopper to form a carrier transport layer with a thickness of 20 μm.

Next, onto the carrier transport layer, a solution prepared by dissolving 120 parts of a carrier transport material (P-6), 6 parts of Exemplified Compound No. 1, and 160 parts of a polycarbonate resin "Upiron Z-800" (manufactured by Mitsubishi Gas Kagaku Corp.) in 1,000 parts of ethylene chloride was coated employing a circular slide hopper to from a protective layer with a thickness of 8 μm, and the resulting coating was thermally dried at 110° C. for 80 minutes to form Example Photoreceptor 1.

Example 2

Example Photoreceptor 2 was prepared in the same manner as for Example 1, except that Exemplified Compound No. 1 in Example 1 was replaced with No. 2, and the carrier transport material (P-6) in the carrier transport layer and protective layer was replaced with (P-7).

Comparative Example 1

Comparative Example Photoreceptor 1 was prepared in the same manner as for Example 1, except that Exemplified Compound No. 1 in Example 1 was removed.

Comparative Example 2

Comparative Example Photoreceptor 2 was prepared in the same manner as for Example 1, except that Exemplified Compound No. 1 in Example 1 was replaced with Comparative compound (H-1).

Comparative Example 3

Comparative Example Photoreceptor 3 was prepared in the same manner as for Example 1, except that Exemplified Compound No. 1 in Example 1 was replaced with Comparative Compound (H-2).

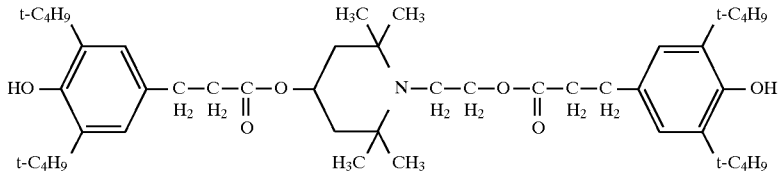

(H-1)

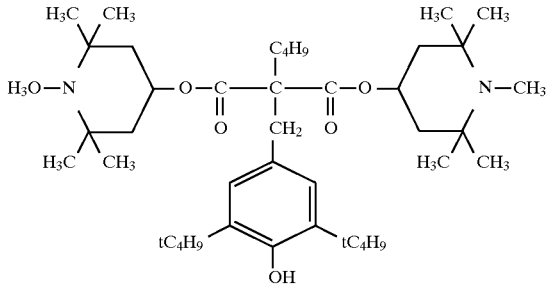

(H-2)

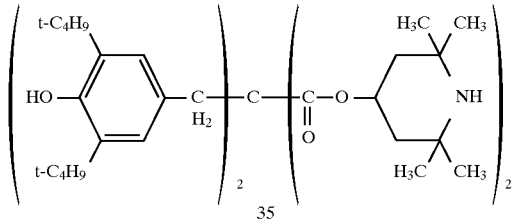

(H-3)

Evaluation 1

As a durability test on the stability of electric potential, each of the Photoreceptors prepared in Examples and Comparative Examples was mounted on a digital copier, "Konica 7050" manufactured by Konica Corp. and was subjected to a test of 10,000 repetitions of charging, exposure, and charge elimination without practical printing at high temperature and humidity (33° C. and 80%). Charging potential Vh, intermediate potential Vg, and residual potential Vr in voltage were measured at the beginning and after 10,000 repetitions.

Furthermore, as an accelerated degradation test on the environment resistance of a photoreceptor, each of Photoreceptors prepared in Examples and Comparative Examples was left in an $NO_x$ exposure vessel ($NO_2$ concentration of about 5 ppm) employing fuming nitric acid. After exposure, the resulting photoreceptor was left in ambient air for 20 minutes, and was then mounted on a digital copier "Konica 7050" manufactured by Konica Corp. A standard chart was copied and the resulting image characteristics were visually evaluated to the four grades while employing Comparative Example 1 as standard.

(Visual Evaluation Standard on Blurred Image)

1: remarkably blurred image

2: blurred image

3: slightly blurred image

4: no blurred image

The results are shown in Table 1.

TABLE 1

| Sample | Added Compound | Initial Characteristics Vh | Vg | Vr | Characteristics after 10,000 Repetitions Vh | Vg | Vr | Image Characteristics after $NO_x$ Exposure |
|---|---|---|---|---|---|---|---|---|
| Example 1 | No.1 | 780 | 324 | 26 | 782 | 326 | 30 | 4 |
| Example 2 | No.2 | 786 | 316 | 24 | 790 | 322 | 30 | 4 |
| Comparative Example 1 | None | 792 | 308 | 28 | 800 | 312 | 34 | 1 |
| Comparative Example 2 | H-1 | 776 | 310 | 32 | 790 | 342 | 88 | 3 |
| Comparative Example 3 | H-2 | 784 | 320 | 30 | 882 | 404 | 116 | 2 |

Example 3

Onto an cylindrical aluminum drum, an interlayer coating solution prepared by dissolving 15 parts of a polyamide resin "CM8000" (manufactured by Toray Inc.) in 100 parts of a mixture of methanol: n-butanol=9:1 to provide an interlayer having a thickness of 0.5 μm.

Onto the resulting coating, a dispersion prepared by dispersing a mixture composed of 12 parts of bisazo compound BA-1 as a carrier generating material, 4 parts of polyvinyl butyral resin "Eslec BX-L" (manufactured by Sekisui Kagaku Co.), and 500 parts of methyl ethyl ketone:cyclohexanone=19:1, employing sand grinder was dip-coated to form a carrier generating layer having a thickness of 0.8 μm.

Thereafter, onto the carrier generating layer, a solution prepared by dissolving 120 parts of a carrier transport material (P-11), 6 parts of Exemplified Compound No. 3, and 160 parts of a polycarbonate resin "Upiron Z-300" (manufactured by Mitsubishi Gas Kagaku Corp.) in 1,000 parts of ethylene chloride was dip-coated to form a carrier transport layer having a thickness of 25 μm, and the resulting coating was thermally dried at a drying temperature of 105° C. for 80 minutes to prepare Example Photoreceptor 3.

Example 4

Example Photoreceptor 4 was prepared in the same manner as for Example 1, except that Exemplified Compound No. 3 was replaced with No. 4.

Example 4

Comparative Example Photoreceptor 4 was prepared in the same manner as for Example 3, except that Exemplified Compound No. 3 was removed.

Example 5

Example Photoreceptor 5 was prepared in the same manner as for Example 3, except that Exemplified Compound No. 3 was replaced with Comparative compound (H-3).

Evaluation 2

Evaluation was carried out in the same manner as for Example 1, except that as the durability test on the stability of electrical potential, each Photoreceptor prepared in Examples and Comparative Examples was mounted on a copier "Konica 4045" manufactured by Konica Corp.

The results are shown in Table 2.

TABLE 2

| Sample | Added Compound | Initial Characteristics Vh | Vg | Vr | Characteristics after 10,000 Repetitions Vh | Vg | Vr | Image Characteristics after $NO_x$ Exposure |
|---|---|---|---|---|---|---|---|---|
| Example 3 | No.3 | 760 | 360 | 28 | 784 | 386 | 56 | 4 |
| Example 4 | No.4 | 724 | 352 | 24 | 744 | 364 | 44 | 4 |
| Comparative Example 4 | None | 736 | 328 | 28 | 760 | 352 | 64 | 1 |
| Comparative Example 5 | H-3 | 768 | 384 | 30 | 832 | 524 | 312 | 2 |

Example 5

Onto an cylindrical aluminum drum, an interlayer solution prepared by dissolving 15 parts of a polyamide resin "CM8000" (manufactured by Toray Corp.) in 100 parts of a mixture of methanol: n-butanol=9:1 was dip-coated to provide an interlayer having a thickness of 0.3 μm.

Onto the resulting coating, a dispersion prepared by dispersing a mixture composed of 5 parts of perylene compound (BA-2) as a carrier generating material, 1 part of polyvinyl butyral resin "Eslec BX-S" (manufactured by Sekisui Kagaku Co.), and 125 parts of methyl ethyl ketone: cyclohexanone=8:2, employing sand grinder was dip-coated to form a carrier generating layer having a thickness of 0.2 μm.

Thereafter, onto the carrier generating layer, a solution prepared by dissolving 100 parts of a carrier transport material (P-7), 5 parts of Exemplified Compound No. 5, and 150 parts of a polycarbonate resin "Upiron Z-300" (manufactured by Mitsubishi Gas Kagaku Corp.) in 1,000 parts of ethylene chloride was dip-coated to form a carrier transport layer having a thickness of 25 $\mu$m.

Thereafter, onto the carrier generating layer, a solution prepared by dissolving 100 parts of a carrier transport material (P-7), 5 parts of Exemplified Compound No. 5, and 150 parts of a polycarbonate resin "TS-2050" (manufactured by Teijin Kasei Co.) in 1,000 parts of ethylene chloride was coated employing a circular slide hopper to form a protective layer having a thickness of 2 $\mu$m. The resulting coating was thermally dried at 110° C. for 60 minutes to prepare Example Photoreceptor 5.

Example 6

Example Photoreceptor 6 was prepared in the same manner as for Example 5, except that Exemplified Compound No. 5 in Example 5 was replaced with No. 8, and carrier transport material (P-7) in the carrier transport layer and protective layer was replaced with (P-12).

Comparative Example 6

Comparative Example Photoreceptor 6 was prepared in the same manner as for Example 5, except that Exemplified Compound No. 5 was removed.

Comparative Example 7

Comparative Example Photoreceptor 7 was prepared in the same manner as for Example 5, except that Exemplified Compound No. 5 was replaced with Comparative Compound (H-3).

Evaluation 3

Evaluation was carried out in the same manner as for Example 1, except that as the durability test on the stability of electrical potential, each Photoreceptor prepared in Examples and Comparative Examples was mounted on a copier "Konica 4355" manufactured by Konica Corp.

The results are shown in Table 3.

TABLE 3

| | Added | Initial Characteristics | | | Characteristics after 10,000 Repetitions | | | Image Characteristics after $NO_x$ |
|---|---|---|---|---|---|---|---|---|
| Sample | Compound | Vh | Vg | Vr | Vh | Vg | Vr | Exposure |
| Example 5 | No. 5 | 846 | 310 | 30 | 874 | 330 | 56 | 4 |
| Example 6 | No. 8 | 862 | 298 | 26 | 886 | 318 | 48 | 4 |
| Comparative Example 6 | None | 856 | 288 | 28 | 878 | 352 | 32 | 1 |
| Comparative Example 7 | H-3 | 842 | 292 | 30 | 932 | 384 | 621 | 2 |

As shown above, it is found that the electrophotographic photoreceptor comprised of an additive of the present invention exhibits stable electrical properties and image characteristics during repeated usage, and excellent durability.

By employing the additive of the present invention, an electrophotographic photoreceptor can be obtained which exhibits the minimum variation in electrical properties such as charging potential, sensitivity, residual potential, etc., and stability in image characteristics such as line-broadening of characters, blurred image, and excellent durability.

We claim:

1. An electrophotographic photoreceptor comprising a conductive support having thereon a photosensitive layer comprising a carrier generating material and a carrier transport material, wherein the above-mentioned photosensitive layer comprises a compound represented by formula (A),

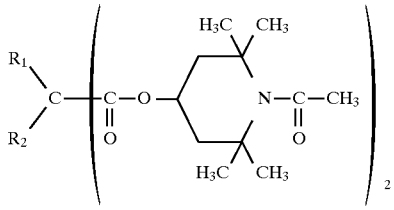

wherein $R_1$ represents a group represented by formula (B), and $R_2$ represents a group represented by formula (B), a hydrogen atom or an alkyl group having from 1 to 9 carbon atoms,

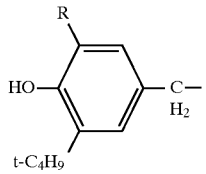

wherein formula R represents an alkyl group having from 1 to 9 carbon atoms.

2. The electrophotographic photoreceptor of claim 1, wherein $R_2$ is hydrogen atom.

3. The electrophotographic photoreceptor of claim 1, wherein $R_2$ is an alkyl group having from 1 to 9 carbon atoms.

4. The electrophotographic photoreceptor of claim 3, wherein $R_2$ is a methyl, ethyl, propyl, butyl or hexyl group.

5. The electrophotographic photoreceptor of claim 1, wherein $R_2$ is a group represented by formula (B)

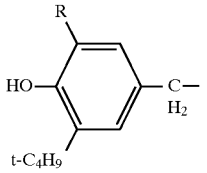

(B)

wherein formula R represents an alkyl group having from 1 to 9 carbon atoms.

6. The electrophotographic photoreceptor of claim 5, wherein R is a methyl or t-butyl group.

7. The electrophotographic photoreceptor of claim 6, wherein R is a t-butyl group.

8. The electrophotographic photoreceptor of claim 1, wherein the carrier transport material is triarylamine, compound, triarylaminestyryl compound, hydrazone compound or pyrazoline compound.

9. The electrophotographic photoreceptor of claim 8, wherein the carrier transport material is a compound represented by formula (C),

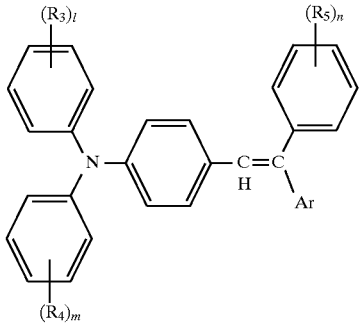

Formula (C)

wherein $R_3$, $R_4$, and $R_5$ each independently represents an alkyl or alkoxy group having from 1 to 5 carbon atoms; l, m, and n each independently represents an integer of 0 to 3; Ar represents a hydrogen atom or a substituted or unsubstituted phenyl group.

10. An electrophotographic photoreceptor of claim 1, wherein the photosensitive layer is composed of a carrier generating layer and a carrier transport layer.

* * * * *